United States Patent [19]

Klafs

[11] 4,216,844

[45] Aug. 12, 1980

[54] FITTING FOR JOINTS OF LADDER SECTIONS

[75] Inventor: Ulrich Klafs, Weilheim, Fed. Rep. of Germany

[73] Assignee: Zarges Leichtbau GmbH, Weilheim, Fed. Rep. of Germany

[21] Appl. No.: 926,275

[22] Filed: Jul. 20, 1978

[30] Foreign Application Priority Data

Jul. 20, 1977 [DE] Fed. Rep. of Germany ..... 2732654

[51] Int. Cl.[2] ..... E06C 7/50; E05D 11/10

[52] U.S. Cl. ..... 182/104; 182/22; 182/165; 16/144

[58] Field of Search ..... 182/22, 23, 24, 25, 182/163, 164, 165, 104; 16/144; 403/96, 113

[56] References Cited

U.S. PATENT DOCUMENTS 3,811,151 5/1974 Kuemmerlin ..... 182/163

*Primary Examiner*—Reinaldo P. Machado

*Attorney, Agent, or Firm*—Becker & Becker, Inc.

[57] ABSTRACT

A fitting for a joint for two ladder sections, which in all angle positions is adapted to lock automatically. This fitting includes a first and a second fitting part which are respectively connectable to the ends of two side pieces of a ladder section and are pivotable about a common axis. The first fitting part has associated therewith a locking unit or element movable parallel to the axis of the joint against the thrust of a return spring from a locking position into an unlocking position and vice versa, while in the second fitting part for each selectable angle position there is provided a bore for receiving the locking unit in its locking position. The locking unit is held by means of a locking mechanism first in its locked position and subsequently, after one fitting part has pivoted relative to the other fitting part, is held by arc sections between the bores of the second fitting part in its unlocked position. The locking mechanism includes a holding part and a control part of which one part each is associated with one of the bores and is directly provided on the locking unit. The locking unit has at least one locking bolt and one guiding pin having its axis coinciding with the axis of the joint axis. The guiding pin is continuously under the action of a return spring and at its free end includes at least one axial projection movable into engagement with that part of the locking mechanism which is associated with the bore in the second fitting.

10 Claims, 5 Drawing Figures

FITTING FOR JOINTS OF LADDER SECTIONS

The present invention relates to a joint fitting for ladder sections comprising two fitting parts connected to the side pieces of the ladder and pivotable about a common axis, the joint fitting being adapted automatically to lock in at least one angle position. More specifically, the present invention relates to a joint fitting of the above mentioned type in which, on the first fitting part, there is mounted a latching element which by means of a handle or the like is adapted against the thrust of a return spring to move from a blocking position into a releasing position and a blocking position parallel to the axis of the joint, whereas in the second joint part, for each selectable angle position, there is provided a bore which is parallel to the axis of the joint and is intended for receiving the latching element in the locking position. The latching element is by means of a locking mechanism first held in the locking position and subsequently, after pivoting one fitting relative to the other fitting is, by segment sections between the bores in the second fitting, held in its unlocked position.

It is an object of the present invention, with a joint fitting of this known type, to improve the safety and to simplify the operation of the joint fitting, and to provide a safer use of the multi-purpose ladder provided with the joint fitting of the above described type.

This object and other objects and advantages of the invention will appear more clearly from the following specification in connection with the accompanying drawings, in which:

FIG. 1 illustrates a joint fitting according to the invention for a locking element with two bolts in connection with the side pieces of two ladder sections.

FIGS. 2 and 3 respectively illustrate in a section taken along the line II—II of FIG. 3 two embodiments of the joint fitting with a locking yoke in its locking position.

Figure 1:
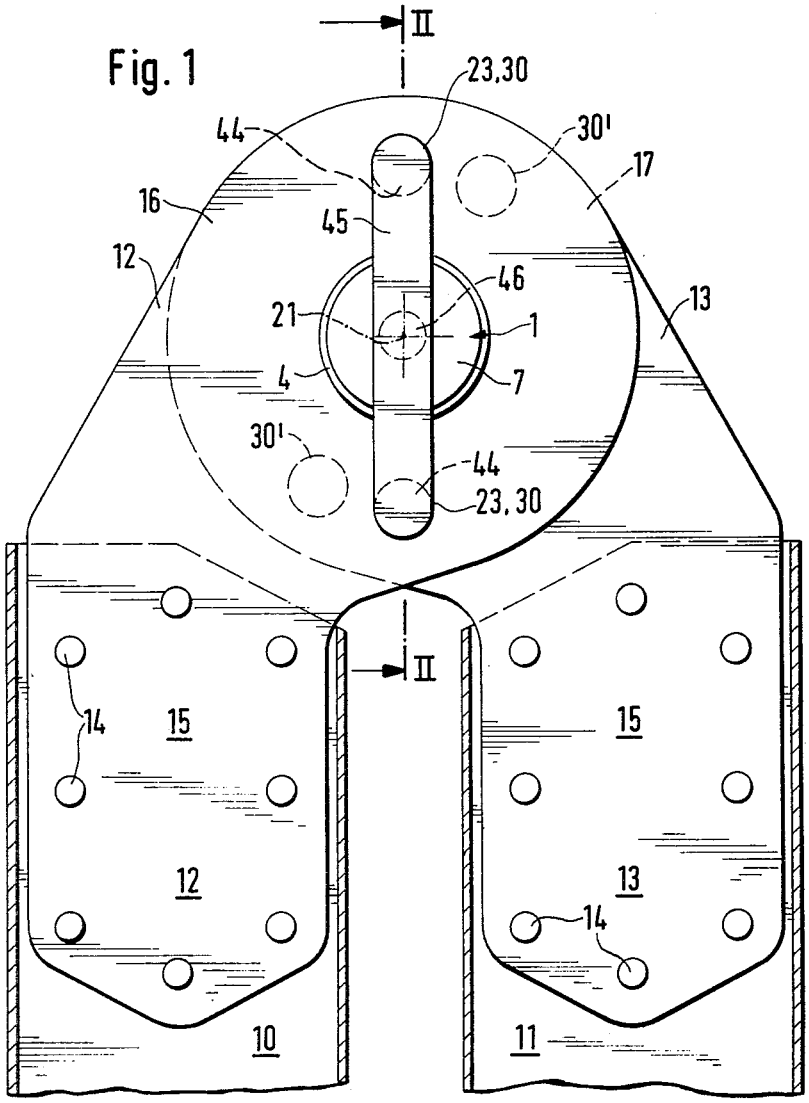

The joint fitting according to the present invention for two ladder sections, according to which the second fitting part is for each selectable angle position provided with a bore parallel to the axis of the joint for receiving the locking element in its locking position, and in which the locking element by means of a locking mechanism is first held in its locking position and subsequently, after pivoting one fitting part relative to the other fitting part, is by means of the segment sections between the bores of the second fitting part held in its unlocked position. The fitting is characterized primarily in that each bore has associated therewith an element consisting of two parts of the locking mechanism. One of these parts is directly formed on the locking element which comprises at least a locking bolt and a guiding pin the axis of which coincides with the axis of the joint. The guiding pin is under the continuous thrust of a return spring and at its free end is provided with at least one axial projection. This projection is adapted to engage an element of the locking mechanism which is associated with the bore in the second fitting part.

This brings about the advantage that for purposes of pivoting the individual ladder parts, for instance of a multi-purpose ladder, only the locking element has to be displaced axially in connection with which the locking element passes through the unlocking position and automatically moves into the locking or blocking position. By means of a single actuation of the locking element itself, the latter is moved into locking position without, to this end, requiring the operation of adjusting members from the outside. Such adjusting members, which with radially adjustable locking bolts are known, require a greater number of structural elements and also require considerable space and, in addition thereto, are easily liable to disorders. Furthermore, these known adjusting members usually limit the pivoting range of two interconnected ladder sections.

The simplified construction according to the present invention is furthermore characterized in that always one part of the two-sectional locking mechanism is arranged directly on the locking element.

To obtain a proper safety arrangement of the ladder sections and a higher loadability of multi-purpose ladders as well as a simplified operation of the ladder, it is, according to the invention, expediently provided that a yoke-shaped locking element comprises two locking bolts arranged diametrically oppositely to each other and an intermediate guiding pin the axis of which coincides with the axis of the joint. This guiding pin is under the influence of a return spring and has its free end provided with two projections which are adapted to engage that portion of the locking mechanism which is associated with the pair of bores in the second fitting part. Alternatively, the guiding pin may have its free end provided with arms having projections adapted to be introduced into the bores. These projections are adapted from the free side of the second fitting part, which free part is located opposite the locking bolts, to be introduced into the bores while being aligned therewith. In this connection, the locking yoke is non-rotatably mounted on the first fitting part and forms a portion of the locking mechanism, whereas the other part of the locking mechanism is fixed in axial direction relative to the second fitting part. The locking mechanism comprises a resilient element or magnet arrangement engaging a recess. Without the application of a major force, the locking mechanism or the locking yoke is movable into locking position as soon as the locking yoke has reached the end of its unlocking movement. Subsequently, the adjacent ladder sections are pivoted relative to each other whereby the projections are pressed outwardly and the locking mechanism is opened. The locking yoke leaves the locking position as soon as the projections, and accordingly the bolts, are no longer completely in alignment with the bores, and the bolts have reached the arched section of the second fitting part adjacent the bores. When the next bore pair has been reached, the locking bolts automatically engage those bores which correspond to the next locking position.

Referring now to the drawings in detail, FIG. 1 shows the ends of the side pieces 10 and 11 of two adjacent ladder sections which form a multi-purpose ladder which may consist of two or more parts. Such multi-purpose ladders may be used as double ladders, single ladders, or the like. They may also be designed as walk-on planks which can be folded up for transporting purposes.

According to the illustrated embodiment, hollow profile side pieces 10 and 11 are provided having connected thereto the members 12 and 13 of the joint fitting. The fitting parts 12 and 13 are to this end provided with legs 15 which by means of screws or rivets 14 are to be connected to the hollow profile side pieces 10 and 11. The fitting parts 12 and 13 may consist of two substantially congruent discs 16 and 17 which have central bores by means of which they are pivotally journalled on a bushing 1 for pivoting about a common axis 21. The bushing 1 has an inner chamber 2 which is open on the side of the second fitting part 13 and on the open end has an outwardly extending round flange 3 which engages the free surface of the second fitting part 13. The two fitting parts 12 and 13 are held together by the flange 3 and a ring 4 which latter is connected to the bushing 1. According to the illustrated embodiment, a spring ring 4 is inserted into a groove 5. At that side of the bushing 1 which is adjacent the groove 5, the bushing 1 has a bottom 7 with a bore 6 for receiving a guiding pin 44.

Provided in the disc 17 and symmetrically with regard to the axis 21 of the joint fitting are two bores 30 each of which is diametrically located opposite to the other. In the locking and blocking position according to FIGS. 1–3, bearing bores 23 in disc 16 of the first fitting part 12 are in alignment with the bores 30 in disc 17. Locking bolts 44 are passed through the bores 30 and 23, while the two locking bolts 44 are connected to a locking yoke or unit 45. Within the region of the axis 21 of the joint fitting, the member, locking unit or element 45 is provided with a guiding pin 46 which is adapted to extend through the bore 6 and which is surrounded by a return pressure spring 25 arranged in the inner chamber 2 and supported on the one hand by the bottom 7 and on the other hand by a sleeve 60 which latter is connected to the free end of the guiding pin 46. The sleeve 60 has a cylindrical circumferential surface 61 by means of which it is slidably guided in the inner chamber 2 of bushing 1. In the extension of the inner member 2, the sleeve 60 has a central recess 62 in which the pressure spring 25 is supported and guided. At the free end of the sleeve 60, which end projects from the bushing 1, there are arranged two radially projecting arms 63 which are located diametrically opposite to each other. To the free ends of the arms 63 there is respectively connected a projection 64. The projections 64 are in alignment with the locking bolts 44 and their domes are spaced from the free end faces 57 of the locking bolts 44. This distance corresponds to the thickness of the disc 17 of the second fitting part 13 or is slightly greater than the thickness of the disc 17. The sleeve 60 is non-rotatably connected to the guiding pin 46 by means of a pin 65 so that the locking yoke 45 forms with the locking bolts 44 a rigid unit, while the sleeve 60 with the arms 63 and the projections 64 forms a rigid unit which is axially displaceable relative to the two fitting parts 12 and 13 and by means of the locking bolts 44 engaging the bores 23 is non-rotatably arranged with regard to the first fitting part 12. In the non-illustrated locking position, the spring 25 presses the yoke 45 against the bottom 70 of bushing 1 while the locking bolts 44 extend through the bores 23 and 30 which are in alignment with each other. The projections 64 are correspondingly lifted off the second fitting part 13. In order to move the rigid locking unit out of its locking position, the yoke 45 may, according to FIGS. 2 and 3, be pulled toward the right, or pressure may be exerted in the same direction upon the sleeve 60 or plate 66 which coaxially surrounds the sleeve 60 and encloses the arms 63. According to this embodiment, the projections 64 may, while being located diametrically opposite to each other, be directly connected to the pressure plate 66.

Figure 2:
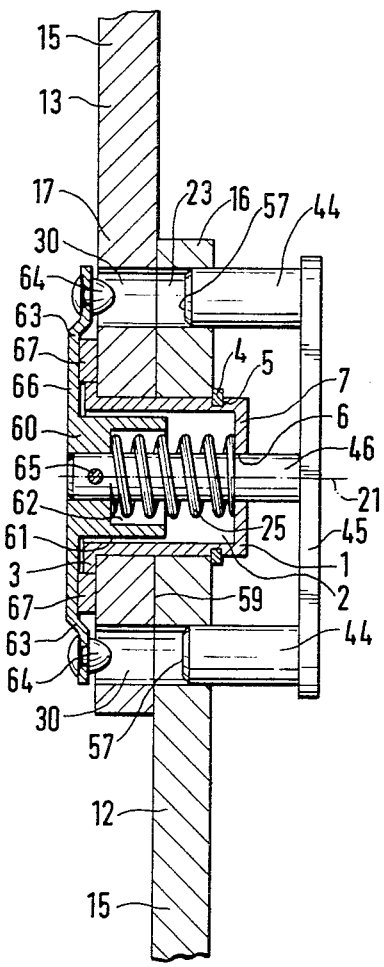

According to the embodiment of FIG. 2, the locking mechanism comprises a magnet arrangement, while a circular or otherwise designed permanent magnet 67 is connected to the disc 17 of the second fitting part 13. The arms 63 or the pressure plate 66 comprises the anchor of the magnet arrangement 66, 67 or form the latter. Alternatively, the permanent magnet 67 may be arranged on the pressure plate 66, whereas the disc 17 forms the anchor or comprises the same.

Figure 3:
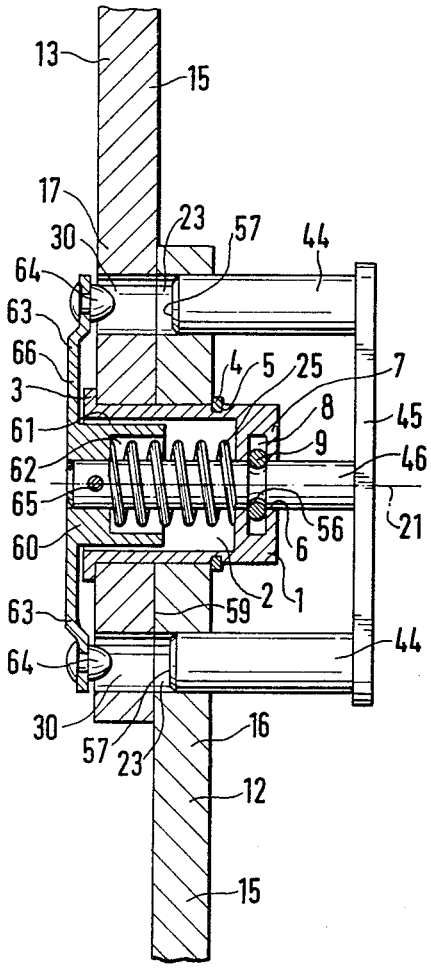

According to the embodiment of FIG. 3, the guiding pin 46 is within the region of the bottom 7 provided merely with a recess 56, which in the specific showing of FIG. 3 consists of an annular groove. In the bottom 7 there is arranged a slot 8 which extends perpendicularly with regard to the axis 21. With this embodiment, the spring 9 has the shape of a hairpin, while the cross section of the pin is circular and thereby is adapted to the cross section of the annular groove. The spring 9 may also be a helical spring which is located in the annular groove 56 and can escape in a corresponding annular slot provided in the bottom 7 when the guiding pin 46 is in the bore 6 adjusted relative to the bottom 7.

Figure 4:
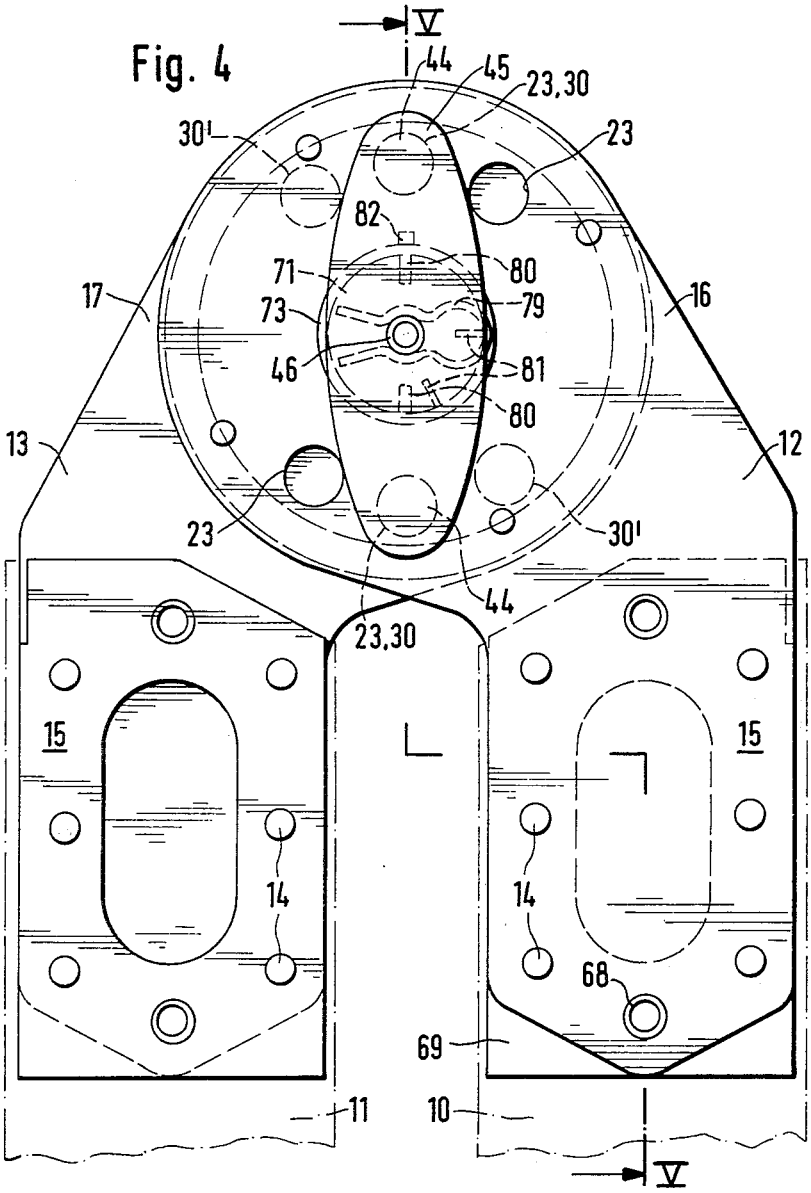
FIG. 4 represents a further embodiment of the joint fitting according to the invention for a locking element with two bolts in connection with the side pieces of two ladder sections.
Figure 5:
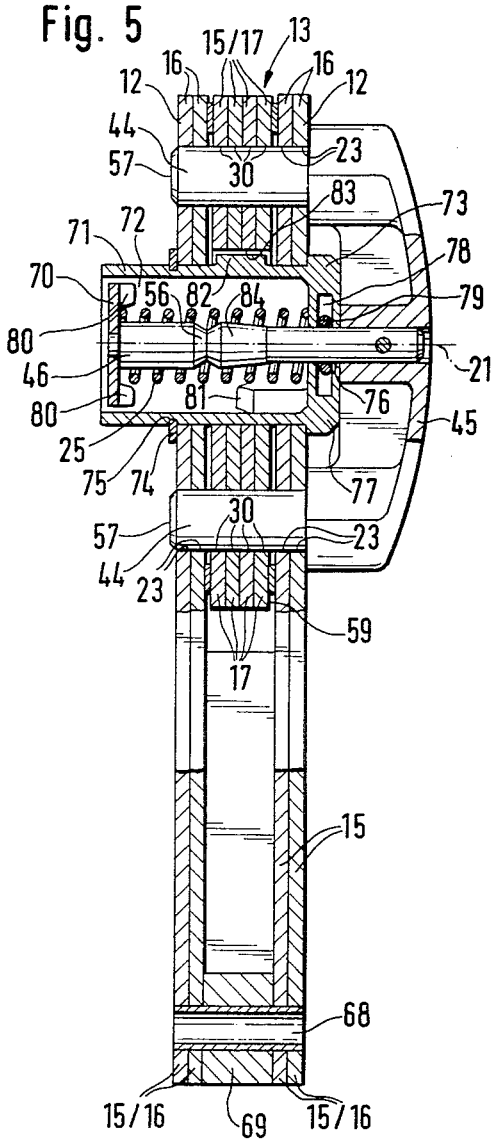
FIG. 5 is a section through a still further embodiment of a joint fitting according to the invention, showing the locking yoke in its locking position, said section being taken along the line V—V of FIG. 4.

According to the embodiment of FIGS. 4 and 5, the discs 16 and 17 are substantially congruent to each other and have central bores by means of which they are journalled on a bushing 71 for pivoting about a common axis 21. Expediently, the fitting parts 12 and 13 are made of identically formed plates 15/16 and 15/17 while two plates 15/16 are respectively located outwardly, while a packet of four plates 15/17 is arranged therebetween. The outwardly located plates 15/16 may be means of the sleeves, hollow rivets or the like 68 and with the spacer members 69 therebetween be fixedly connected to the first fitting part 12, whereas the plate packet 15/17 forms the second fitting part 13.

The bushing 71 has a unilaterally open inner chamber 72 and at the closed end has an outwardly extending round flange 73 which engages one of the free surfaces of the first fitting part 12. The bushing 71 is axially fixed by means of the flange 73 and a ring 74 which is connected within the region of the open end of bushing 71. According to the specific embodiment shown in FIGS. 4 and 5, a spring ring 74 is inserted into a groove 75. On that side of the bushing which is adjacent the flange 73, the bushing has a bottom 77 with a bore 76 for a guiding pin 46.

In disc 17, symmetrically to the joint axis 21, there are respectively provided two bores 30 each which are located diametrically opposite to each other. In the locking position shown in FIGS. 4 and 5 and in the blocking position, the bearing bores 23 provided in the disc 16 of the first fitting part 12 are in alignment with the bores 30 in disc 17. Locking bolts 44 are respectively placed in the bores 30 and 23. The two locking bolts 44 are connected to a blocking yoke 45. In the region of the joint axis 21, the yoke 45 has a guiding pin 46 extending through the bore 76. The guiding pin 46 is surrounded by a return pressure spring 25 which is arranged in the inner chamber 72 and on the one hand rests against the bottom 77 and on the other hand rests against a dish 70 which is connected to the free end of the guiding pin 46. The dish 70 closes off the inner chamber and has two projections 80 which are diametrically oppositely located to each other and extend into the inner chamber. The projections 80 are associated with the locking bolts 44, and their heads are axially spaced from at least one abutment 81 provided in the bushing 71. This axial distance corresponds to at leat the thickness of two plates 15/16 of the first fitting part plus the thickness of four plates 15/17 of the second fitting part 13 or this distance is slightly greater than this thickness. The dish 70 is non-rotatably connected to the guiding pin 46 so that the locking yoke 45 together with the locking bolts 44 and the dish 70 with the projections 80 form a rigid unit which is axially adjustable relative to the two fitting parts 12 and 13 and is non-rotatably arranged relative to the first fitting part 12 by means of the locking bolts 44 which always engage the bores 23 adjacent to the yoke 45. The bushing 71 is by means of an outwardly located fin 82 non-rotatably secured relative to the second fitting part 13 which latter in the formed plates 15/17 has a corresponding groove 83 which, for manufacturing reasons, may also be provided in the plates 15/16.

In the illustrated locking position, the spring 25 presses the yoke 45 against the bottom 77 of bushing 71 while the locking bolts 44 extend through the bores 23 and 30 which are in alignment with each other. The projections 80 are correspondingly lifted off the abutment 81 which is connected to the second fitting part 13. In order to be able to move the rigid locking unit out of its locking position, the yoke 45 may, according to FIG. 5, be pulled toward the right, or pressure may be exerted in the same direction upon the dish 70. With the illustrated embodiment, two projections 80 are located diametrically opposite to each other and are aligned with the locking bolts 44. Two pairs of bores 23 and 30 each are provided in each of the formed plates 15/16 and 15/17 which are arranged relative to each other at an angle of 30°, while in FIG. 1 the pairs of bores of the second fitting part 13 are designated with the reference numerals 30 and 30' respectively. It will be evident from the above that a total of four different locking positions or angle positions between the side pieces 10 and 11 can be set. For moving the locking unit out of its blocking position into the release position between the four different positions, two abutments 81 are arranged in the inner chamber 72 of the bushing 71. These abutments are respectively located in about the middle between two adjacent bores 30 (FIG. 4).

According to FIG. 5, the guiding pin 46 is provided with a flat annular groove 56. In the bottom 77 there is arranged a slot 78 which extends at a right angle to the axis 21, a spring 79 being located in the slot 78. A spring 79 has, according to the specific showing of this embodiment, the shape of a hairpin while the cross section of the pin is circular and thus is adapted to the cross section of the annular groove 56. The spring 79 may also be a helical spring which in its blocking position is located in the annular groove 56 and is adapted to escape into a corresponding annular slot in the bottom 77 when the guiding pin 46 in the bore 76 is adjusted relative to the bottom 77.

If the ladder sections 10 and 11 are to be tilted or pivoted, the rigid locking unit is in the described manner moved toward the right with regard to FIGS. 2, 3 and 5. To this end, either an axial pressure is exerted upon the plate 66 or dish 70, or an axial pull is exerted upon the locking yoke 45. For unlocking the locking bolts 44 according to FIGS. 1–3, these bolts are moved out completely of the bores 30 until the pressure plate 66 comes into engagement with the permanent magnet 67, or the spring 9 springs into the annular groove 56. For unlocking the locking bolts 44 according to FIGS. 4 and 5, these bolts are completely moved out of the bores 23 of the discs 16 facing away from the yoke 45 and out of the bores 30 of the discs 17 until the spring 79 springs into the annular groove 56. During this customary unlocking movement, the rigid locking unit has completely passed through the unlocking position and is fixed in its locking position. In this locking position, the bolts 44 have left the bores 30, and the free end faces 57 of bolts 44 will be located slightly above the contact surface 59 between the discs 16 and 17 of the fitting parts 12 and 13 or between the disc 16 which are located on the side of the yoke 45 and the disc packet 17 of the second fitting part 13. In this position of the locking unit, the ladder sections 10 and 11 can easily be tilted, in which connection the locking yoke 45 is taken along due to the fact that the bolts 44 are guided in the bores 23 of the disc 16 of the first fitting part 12 which disc faces toward the yoke 45. During the tilting or pivoting of the second fitting part 13 relative to the first fitting part 12, the projections 64 are displaced out of the bores 30, or one of the projections 80 comes into contact with one of the abutments 81 and is pressed back by the latter so that the anchor of the pressure plate 66 is freed from the permanent magnet 67, or the spring 9, 79 leaves the annular groove 56, and the guiding pin 46 can be freely passed between the legs of spring 9, 79. The legs of spring 9, 79 slide over the circumference of the pin 46 which latter, according to FIG. 5, at this area may have a conical taper 84. The conical taper 84 will during the unlocking operation spread the spring 79 and during the locking aids the action of the return pressure spring 25. By means of this pressure spring 25, the locking bolts 44 are moved in the direction of the contact surface 59 until their free end faces 57 rest upon the contact surface 59 which between the bores 30 and the adjacent bores 30' has a closed arched section. This non-illustrated unlocking position of the locking unit makes it possible to pivot the ladder sections 10 and 11 free from impedements until the locking bolts 44 are precisely in alignment with the bores 30' and, due to the thrust of the return pressure spring 25, drop into the bores 30' and the bores 23 of the disc facing away from yoke 45. This movement is not interfered with by the locking mechanism. The locking unit will then in its new angular position occupy its locking position. If the multi-purpose ladder is again to be returned to its starting position according to FIGS. 1 or 4, it is merely necessary to displace the locking unit in the described manner until the locking position has been reached. The ladder parts 10 and 11 are then pivoted in the opposite direction.

The number of the selectable angular positions of the ladder parts 10 and 11 is, of course, not limited to four, but may in a simple manner be selected in conformity with the number of the pairs of bores, 30, 30' in the disc 17 of the second fitting part 13, and according to FIGS. 4 and 5 may be selected in conformity with the number of bores 23 provided in the disc 16 of the first fitting part 12 which disc faces away from the yoke 45. In the disc 16 of the first fitting part 12, which disc faces the yoke 45, it is merely necessary to provide a pair of bores 23.

It is, of course, to be understood that the present invention is, by no means, limited to the specific showing in the drawings, but also encompasses any modifications within the scope of the appended claims.

What is claimed is:

1. A fitting for a joint for pivotally interconnecting two ladder sections and automatically interlocking the same in at least one angle position, which includes: a first fitting part and a second fitting part, a joint pivotally interconnecting said first and second fitting parts to each other for pivoting about a common axis, said first and second fitting parts respectively being connectable to the upper ends of two ladder sections, a locking unit associated with said first fitting part and comprising locking pin means, said second fitting part being provided with at least one bore for each angle position with regard to said first fitting part, a guiding pin having its axis coinciding with said common axis, manually operable means of said locking unit connecting said guiding pin to said locking pin means, and spring means associated with said guiding pin and continuously urging said locking pin means toward said second fitting part so as to move said locking pin means into said at least one bore in response to the alignment of the latter with said locking pin means, said locking unit being operable against the thrust of said spring means to withdraw said locking pin means from the respective bore aligned therewith, and a locking mechanism to hold the locking unit in its unlocked position until, after one fitting part has pivoted relative to the other fitting part, being held by arc sections between the bores of said second fitting part in its unlocked position.

2. A fitting for a joint for pivotally interconnecting two ladder sections and automatically interlocking the same in at least one nagle position, which includes: a first fitting part and a second fitting part, a joint pivotally interconnecting said first and second fitting parts to each other for pivoting about a common axis, said first and second fitting parts respectively being connectable to the upper ends of two ladder sections, a locking unit associated with said first fitting part and comprising locking pin means, said second fitting part being provided with at least one bore for each angle position with regard to said first fitting part, a guiding pin having its axis coinciding with said common axis, manually operable means of said locking unit connecting said guiding pin to said locking pin means, and spring means associated with said guiding pin and continuously urging said locking pin means toward said second fitting part so as to move said locking pin means into said at least one bore in response to the alignment of the latter with said locking pin means, said locking unit being operable against the thrust of said spring means to withdraw said locking pin means from the respective bore aligned therewith, said locking unit including a yoke-shaped member, and said locking pin means comprising two locking bolts diametrically arranged opposite to each other, and connected to said yoke-shaped member, said second fitting part comprising at least two pairs of bores adapted respectively to receive said two locking bolts, said guiding pin having that end thereof which is remote from said locking unit provided with protrusions adapted respectively to be aligned with one of said two pairs of bores for at least partial introduction thereinto.

3. A fitting for a joint for pivotally interconnecting two ladder sections and automatically interlocking the same in at least one angle position, which includes: a first fitting part and a second fitting part, a joint pivotally interconnecting said first and second fitting parts to each other for pivoting about a common axis, said first and second fitting parts respectively being connectable to the upper ends of two ladder sections, a locking unit associated with said first fitting part and comprising locking pin means, said second fitting part being provided with at least one bore for each angle position with regard to said first fitting part, a guiding pin having its axis coinciding with said common axis, manually operable means of said locking unit connecting said guiding pin to said locking pin means, and spring means associated with said guiding pin and continuously urging said locking pin means toward said second fitting part so as to move said locking pin means into said at least one bore in response to the alignment of the latter with said locking pin means, said locking unit being operable against the thrust of said spring means to withdraw said locking pin means from the respective bore aligned therewith, said locking unit including a yoke-shaped member, and said locking pin means comprising two locking bolts diametrically arranged opposite to each other and connected to said yoke-shaped member, said second fitting part comprising at least two pairs of bores adapted respectively to receive said two locking bolts and abutment means associated with at least one of said two bores in said second fitting part, said guiding pin having that end thereof which is remote from said yoke-shaped member provided with two axially directed projections for cooperation with said abutment means when adjusting said two fitting parts with regard to each other.

4. A fitting according to claim 3, in which said locking unit is nonrotatably connected to said first fitting part, and in which said locking mechanism includes annular groove means at said guiding pin, and a holding member provided by a resilient member and provided within a radial recess adjacent said guiding pin, said annular groove means in the locked position of said locking mechanism of said locking unit being in radial alignment with said recess and engaged by said resilient member.

5. A fitting according to claim 2, in which protrusions are supported by supporting means connected to said guiding pin, and in which said locking unit is non-rotatably connected to said first fitting part, said locking mechanism including: a permanent magnet system having one part thereof connected to said second fitting part and associated with said supporting means, the holding power of said permanent magnet system being effective in the locked position of said locking mechanism only.

6. A fitting according to claim 2, in which in interlocked position of said first and second fitting parts said protrusions are located outside said bores but in axial alignment therewith, and in which in non-interlocked position of said first and second fitting parts said locking bolts are slidably movable on the arc sections between said bores of said second fitting part.

7. A fitting according to claim 4, in which said holding member is provided at a joint axle bushing with a bottom having said guiding pin axially adjustably arranged therein, said bottom being provided with a circular slot, and said guiding pin being provided with said annular groove adapted to be engaged by said resilient member in interlocked position of said locking mechanism.

8. A fitting according to claim 3, in which each of said first and second fitting parts are provided with two pairs of bores spaced from each other by an angle of about 30°.

9. A fitting according to claim 3, in which said guiding pin has that end thereof which is remote from said locking unit provided with two axial projections extending in axial direction of said guiding pin and in the direction toward said locking unit, and which includes a joint axle bushing surrounding said guiding pin and having arranged therein two abutments respectively located between each two adjacent bores of said second fitting part.

10. A fitting according to claim 2, in which each of said first and second fitting parts are provided with two pairs of bores spaced from each other by an angle of about 30°.

* * * * *